US005681233A

United States Patent [19]

Guenther et al.

[11] Patent Number: 5,681,233

[45] Date of Patent: Oct. 28, 1997

[54] INFLATABLE GAME BALL WITH SPONGE RUBBER CARCASS

[75] Inventors: Douglas G. Guenther, Carol Stream; Bradley L. Gaff, Naperville, both of Ill.; San-Fu Yang, Taiwan, Taiwan; Takeo Suzuki, Tokyo, Japan

[73] Assignee: Wilson Sporting Goods Co., Chicago, Ill.

[21] Appl. No.: 723,607

[22] Filed: Oct. 2, 1996

[51] Int. Cl.[6] ..... A63B 41/08

[52] U.S. Cl. ..... 473/605; 473/604

[58] Field of Search ..... 473/598, 599, 473/597, 603, 604, 605, 607, 608, 609, 143, 144, 145, 148, 150, 152, 158, 159

[56] References Cited

U.S. PATENT DOCUMENTS

| | | | |
|---|---|---|---|
| 2,494,796 | 1/1950 | Brown | 473/605 |
| 3,119,618 | 1/1964 | Molitor . | |
| 3,506,265 | 4/1970 | Yugi | 473/604 |
| 4,187,134 | 2/1980 | Svub et al. | 473/605 |
| 4,462,590 | 7/1984 | Mitchell . | |
| 4,660,831 | 4/1987 | Kralik | 473/603 |
| 5,320,345 | 6/1994 | Lai | 473/603 |
| 5,542,662 | 8/1996 | Kouzai et al. | 473/605 |
| 5,551,688 | 9/1996 | Miller . | |

FOREIGN PATENT DOCUMENTS

WO 96/35482 11/1996 WIPO .

*Primary Examiner*—Steven B. Wong

[57] ABSTRACT

A game ball comprises an inflatable rubber bladder, a layer of windings over the bladder, panels of sponge rubber over the wound bladder, rubber channels between adjacent panels of sponge rubber, and panels of cover material over the panels of sponge rubber. Before the panels of cover material are applied, the bladder, sponge rubber, and channels are cured in a heated mold to bond the rubber channels and the sponge rubber to the wound bladder. After the panels of cover material are applied, the ball is heat molded to bond the cover material to the rubber channels and the sponge rubber.

6 Claims, 1 Drawing Sheet

INFLATABLE GAME BALL WITH SPONGE RUBBER CARCASS

BACKGROUND

This invention relates to game balls, and, more particularly, to an inflatable game ball having a sponge rubber carcass.

Game balls such as basketballs, soccer balls, and footballs conventionally include an inflatable bladder and a cover. The bladder may be reinforced with windings of nylon thread, polyester thread, etc. The cover is conventionally formed from panels of cover material, for example, rubber, and adjacent panels are separated by rubber channels.

The portion of the ball excluding the cover is conventionally referred to as the carcass. In order to improve a player's ability to grip the ball and to reduce the shock of impact, the carcasses of some game balls have included cushion material, for example, sponge rubber. However, the cover panels which cover the cushion material do not adhere well to the cushion material, and the cover panels have a tendency to peel away from the cushion material.

SUMMARY OF THE INVENTION

The invention provides an inflatable game ball with a sponge rubber carcass and rubber channels which are integrated with the bladder. The cover panels are bonded to the rubber channels, and the cover panels are thereby tied to the carcass. Shear loads on the cover panels are transferred to the carcass, and the tendency of the cover panels to peel away from the sponge rubber is substantially reduced.

DESCRIPTION OF THE DRAWING

The invention will be explained in conjunction with an illustrative embodiment shown in the accompanying drawing, in which.

DESCRIPTION OF SPECIFIC EMBODIMENTS

Figure 1:
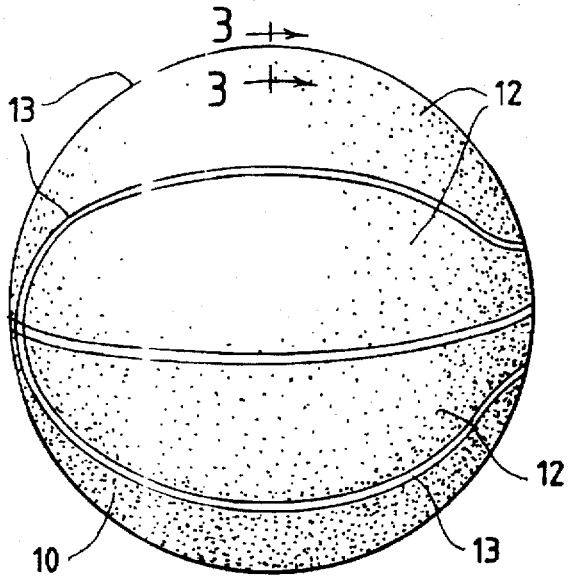
FIG. 1 illustrates a basketball formed in accordance with the invention.

The invention will be explained with reference to a basketball 10 illustrated in FIG. 1. It will be understood, however, that the invention can be used with other inflatable game balls.

The basketball 10 includes an inflatable bladder 11 (FIG. 3), a plurality of cover panels 12, and rubber channels 13 which separate adjacent cover panels. The basketball 10 has the appearance of a conventional basketball. However, as will be explained hereinafter, the basketball includes a sponge rubber carcass which is covered by the cover panels.

The bladder 11 may be manufactured in the conventional manner from conventional bladder materials. The bladder is preferably formed primarily of rubber. In the preferred embodiment the bladder was made from 80% butyl rubber and 20% natural rubber.

Figure 2:
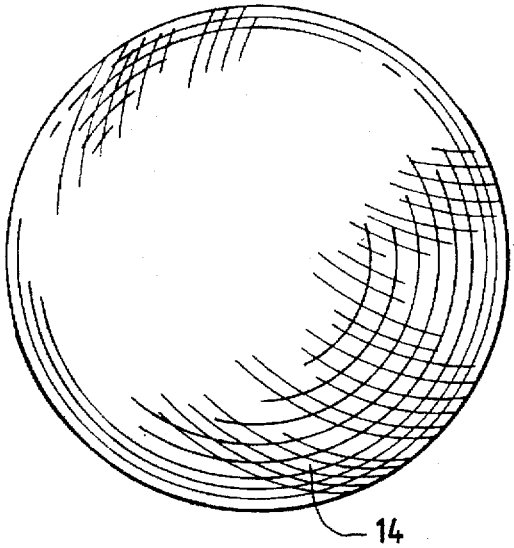
FIG. 2 illustrates a wound bladder before the panels of sponge rubber are applied.
Figure 3:
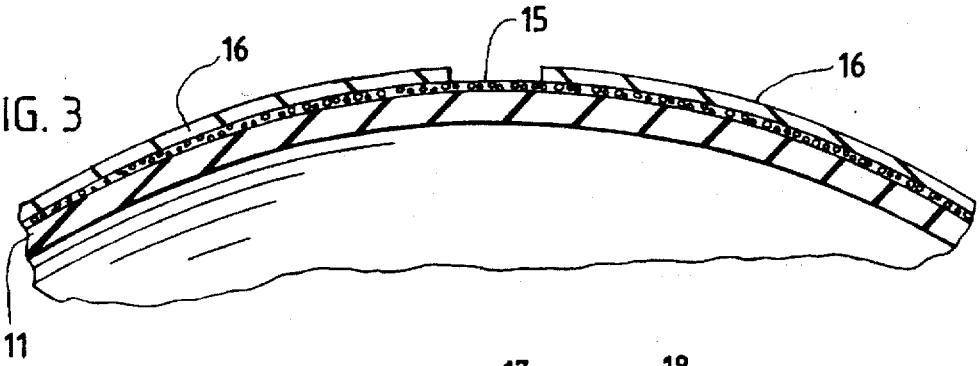
FIG. 3 is a sectional view of the carcass of the basketball as would be seen along the line 3—3 of FIG. 1 after the panels of sponge rubber are applied to the wound bladder.

The bladder is inflated and placed in a vulcanizing or curing mold where the bladder is cured at 160° C. After curing, the inflated bladder is wound with reinforcing thread 14 (FIG. 2) which forms a layer of windings 15 (FIG. 3). In the preferred embodiment the layer of windings was formed from 2100 meters of 210 denier Nylon 66 thread.

Flat sheets or panels of sponge rubber 16 are laid on the wound bladder. The panels of sponge rubber have substantially the same shape as the cover panels 12. The panels of sponge rubber are arranged so that a gap of about 5 mm. separates adjacent panels.

Figure 4:
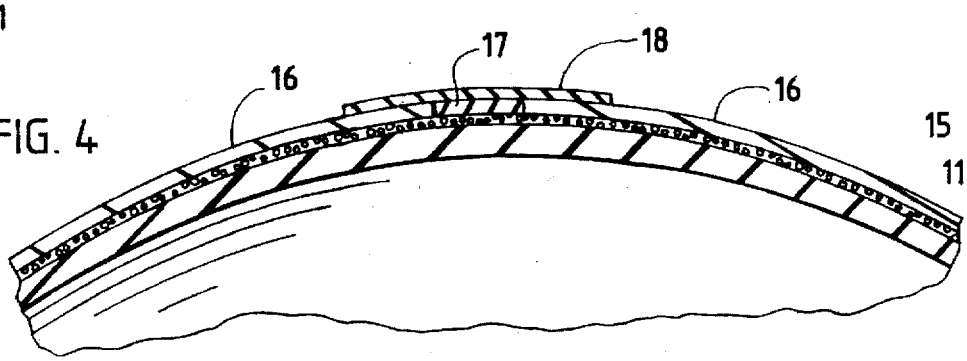
FIG. 4 is a view similar to FIG. 3 after the rubber strips are applied.

A first or lower strip of rubber 17 (FIG. 4) is then inserted into each of the gaps. The width of the lower strip of rubber is substantially the same as the width of the gap, and the height of the lower strip is substantially the same as the height of the gap.

A 20 mm. wide upper strip of rubber 18 is then laid on top of each of the lower rubber strips 17. The wider upper rubber strips overlap the edge portions of the panels of sponge rubber which form the gaps.

The product at this stage of the manufacturing process is called the carcass. The carcass is placed in a spherical mold, and the inflated carcass is heat molded at 160° C. During the molding process, the lower rubber strips melt into the windings and fuse to the rubber bladder, and the upper and lower rubber strips fuse together. The rubber strips are thereby mechanically and chemically bonded to, an integrated with, the wound bladder.

At the same time, a foaming agent in the sponge rubber foams and creates a cellular structure in the foam rubber. The foam rubber also bonds to the wound bladder.

Figure 5:
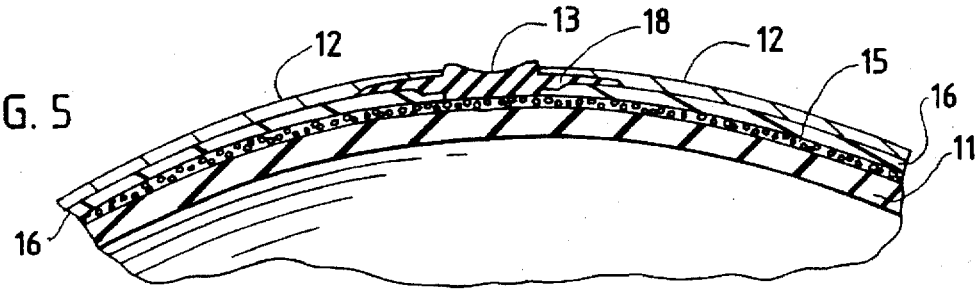
FIG. 5 is a sectional view of the basketball taken along the line 3—3 of FIG. 1.

After the carcass is removed from the carcass mold, panels of cover material 12 are hand laid over the panels of sponge rubber. Adhesive is applied to both the cover material and the carcass. The cover panels have substantially the same shape as the sponge rubber panels, and edge portions of the cover panel overlie the rubber strips 18 (FIG. 5). The edges of adjacent cover panels are separated to form gaps over the central portions of the rubber strips.

The inflated ball is then placed in a mold and heat molded at 40° C. to bond the cover panels 12 to the carcass. During the final heat molding step, portions of the rubber strips are forced upwardly between the gaps between the cover panels 12 to form the rubber channels 13.

The edges and bottom surfaces of the edge portions of the cover panels are bonded to the rubber channels 13 and to the underlying rubber strips 18. The cover panels are also bonded to the sponge rubber panels 16.

The rubber strips 17 and 18 are vulcanized into the underlying wound bladder and are thereby integrated with the wound bladder. The cover panels 12 are bonded or integrated with the rubber strips and are thereby tied directly to the wound bladder.

As the ball is used, shear loads are created on the cover panels, and a substantial amount of the shear loading is transferred through the rubber strips to the wound bladder. The sponge rubber is therefore not required to withstand all of the shear loading, and the tendency of the sponge rubber to peel away from the wound bladder is substantially reduced. The durability of the ball is thereby greatly improved.

The sponge rubber provides the ball with a softer feel and makes the ball easier to grip. The ball also produces less shock on impact.

In one specific embodiment the rubber strips 17 and 18 had the composition set forth in Table 1, and the sponge rubber panels 16 had the composition set forth in Table 2. The listed ingredients are conventional and well known in the rubber art.

The cover panels 12 are synthetic leather material made up of non-woven backing cloth made up of small denier (0.01 denier or less) non-woven nylon and a polyurethane coating. The total thickness of the panels is 1.6 mm or greater. The surface of the cover panels has a high coefficient of friction with regard to the human hand. The density of the non-woven backing cloth is between 0.30 to 0.40 grams per cubic centimeter.

TABLE 1

| CHANNEL RUBBER RECIPE (amount in grams) | |
|---|---|
| RSS No. 3 | 70.00 |
| BROI | 30.00 |
| Zinc Oxygen | 5.00 |
| Stearic Acid | 1.00 |
| Accelerator, DM | 1.00 |
| Accelerator, TT | 0.15 |
| Sulfur | 2.50 |
| Antioxidant, SP | 1.00 |
| Antioxidant, NS | 0.70 |
| Carbonic Black HAF | 20.00 |
| Carbonic Black FEF | 10.00 |
| Hakuenka CC. | 40.00 |
| Sunwax | 0.60 |
| Process oil | 4.50 |
| Total | 186.45 grams |

TABLE 2

| SPONGE RUBBER RECIPE (amount in grams) | |
|---|---|
| RSS No. 1 | 60.00 |
| BRO1 | 20.00 |
| SBR1778 | 20.00 |
| Zinc Oxygen | 4.80 |
| Accelerator, M | 0.50 |
| Accelerator, DM | 0.60 |
| Accelerator, TS | 0.18 |
| Sulfur | 2.40 |
| Antioxidant Sp | 0.50 |
| Antioxidant NS | 0.60 |
| Hakuenka CC. | 40.00 |
| Carbonic Black FEF | 10.00 |
| Carbonic Black HAF | 10.00 |

TABLE 2-continued

| SPONGE RUBBER RECIPE (amount in grams) | |
|---|---|
| Process bil | 8.00 |
| Stearic Acid | 1.00 |
| Cellmike | 4.50 |
| Total | 183.18 grams |

While in the foregoing specification a detailed description of a specific embodiment of the invention was set forth for the purpose of illustration, it will be understood that many of the details herein given can be varied considerably by those skilled in the art without departing from the spirit and scope of the invention.

We claim:

1. A game ball comprising:

an inflatable bladder, a layer of windings over the bladder, a plurality of panels of sponge rubber over the windings, adjacent panels being separated by gaps, a plurality of strips of rubber positioned in said gaps between adjacent panels of sponge rubber, and panels of cover material covering the panels of sponge rubber and leaving portions of the strips of rubber uncovered.

2. The game ball of claim 1 in which each of said strips of rubber includes a lower portion which is positioned in a gap between adjacent panels of sponge rubber and an upper portion which overlies edge portions of said adjacent panels of sponge rubber.

3. The game ball of claim 2 in which the panels of cover material overlie edge portions of the upper portions of the strips of rubber.

4. The game ball of claim 1 in which the cover material comprises polyurethane.

5. The game ball of claim 1 in which the cover material comprises polyurethane and microfibers.

6. The game ball of claim 1 in which said bladder comprises substantially rubber.

* * * * *